US005145110A

United States Patent [19]

Terpstra

[11] Patent Number: 5,145,110

[45] Date of Patent: Sep. 8, 1992

[54] BOX CONSTRUCTION WITH INTERLOCKING TAB FASTENING MEANS

[76] Inventor: Nicholas Terpstra, 260 Drake La., Ledgewood, N.J. 07852

[21] Appl. No.: 765,566

[22] Filed: Sep. 25, 1991

[51] Int. Cl.[5] ..... B65D 5/10

[52] U.S. Cl. ..... 229/155; 229/185

[58] Field of Search ..... 229/152, 153, 155, 156, 229/157, 195, 185

[56] References Cited

U.S. PATENT DOCUMENTS

| | | | |
|---|---|---|---|
| 529,308 | 11/1894 | Pinkerton | 229/157 |
| 2,053,857 | 9/1936 | Weiss | 229/157 |
| 2,361,603 | 10/1944 | Cohen et al. | 229/157 |
| 3,750,933 | 8/1973 | Nicolay | 229/155 |
| 3,792,810 | 2/1974 | Tingley et al. | 229/155 |
| 3,951,330 | 4/1976 | Desmond | 229/155 |
| 4,094,459 | 6/1978 | Coons | 229/155 |
| 4,291,827 | 9/1981 | Mulroy | 229/156 |
| 4,884,741 | 12/1989 | Nederveld | 229/157 |
| 4,953,782 | 9/1990 | Noland | 229/157 |

FOREIGN PATENT DOCUMENTS

| | | | |
|---|---|---|---|
| 192862 | 2/1938 | Switzerland | 383/93 |
| 1482859 | 5/1989 | U.S.S.R. | 229/158 |

*Primary Examiner*—Stephen Marcus
*Assistant Examiner*—Christopher J. McDonald
*Attorney, Agent, or Firm*—Klauber & Jackson

[57] ABSTRACT

A flat, collapsible blank which is assembled to form a box of suitable thickness and sufficient rigidity. Four panels of the same size and shape are hinged serially. Each has folding end flaps with diagonally opposed tabs and opposing bevelled corners. Further, each end flap has a slot situated such that it cooperates with and is joined by the tab on the end flap of the adjacent panel. Hence, the interlocking box has interlapping end flaps which when taken together form the top and bottom panels of the box. Additionally, each corner tab has a meshed area on the exterior surface thereof, and each slot has a meshed area on the interior surface thereof, such that the two meshed areas cooperate. These meshed areas are used to add rigidity and support to the top and bottom panels when each end flap is folded in its configuration during use. The box can also be used by children as a toy or plaything, being large enough for them to climb into.

3 Claims, 3 Drawing Sheets

BOX CONSTRUCTION WITH INTERLOCKING TAB FASTENING MEANS

The invention described herein relates to a box constructed from a blank with interlocking flaps designed to allow rapid and easy assembly and disassembly. The blank utilizes tabs and slots which hold the box in the assembled configuration. The box is reusable without the need for sealing tape and/or glue to keep the ends closed.

BACKGROUND OF THE INVENTION

The invention described herein addresses a box and a blank which can be folded into a box having interlapped end flaps, and tabs and notches which cooperate to hold the box in a generally rectangular configuration.

In the past, interlapped end flaps have been used to close boxes with differing degrees of success. Normally, box end flaps do not have corners designed to be inserted into slots on the adjacent end flaps. In particular, boxes constructed in the past have not typically had slots interspaced away from the corners, and have not utilized tabs which can be inserted into these slots to make the normal interweaving of the box end flaps more secure. Consequently, the strength of boxes with interlapped end flaps has depended upon the relative strength of the material from which the box is constructed, the relative extent of the overlap between the end flaps, the degree of overall strength embodied in the box material, the presence or absence of adhesives, sealing tape or other fasteners, such as staples, and numerous other factors.

Consequently, there has been a long felt need for a blank and a box which can be constructed therefrom with interlocking end flaps which are notched to form tabs and slots to surprisingly strengthen the configuration when the box is assembled. Additionally, there has been a long felt need for boxes which are capable of being unfolded and stored in the flat condition, and which can be reassembled into the box configuration without substantially weakening after repeated use, thus retaining substantially the same strength as when used in the initial box configuration.

SUMMARY OF THE INVENTION

The invention described herein relates to an improved box or blank which is configured to form a box. The blank is comprised of four main panels integrally hinged to each other and erectable from a collapsed position into a locked, assembled or erect condition. Each of the main panels is substantially the same size and shape and has a flap on each of the ends of each panel. Each flap has a tab which is formed by cutting notches into the end flap. Each notch is substantially the same width as the thickness of the cardboard box end flap, and a pair of notches is used to form each tab. When the end flaps on a given panel are considered together, there is formed a pair of diagonally placed corner tabs situated so as to cooperate with the slots in the adjacent panels. Additionally, also diagonally opposed with respect to each panel is a pair of clipped or beveled corners of sufficient dimension to permit interlapping and cooperation between the corner tabs and the disposed slots.

Additionally, the top and bottom edges of the blank overlap when the box is in the folded (closed) condition.

Said overlapping edges can be permanently joined with a suitable adhesive or sealant if desired.

BRIEF DESCRIPTION OF THE DRAWINGS

The invention is described herein in detail in conjunction with the accompanying drawings, in which.

DETAILED DESCRIPTION OF THE INVENTION

Figure 1:
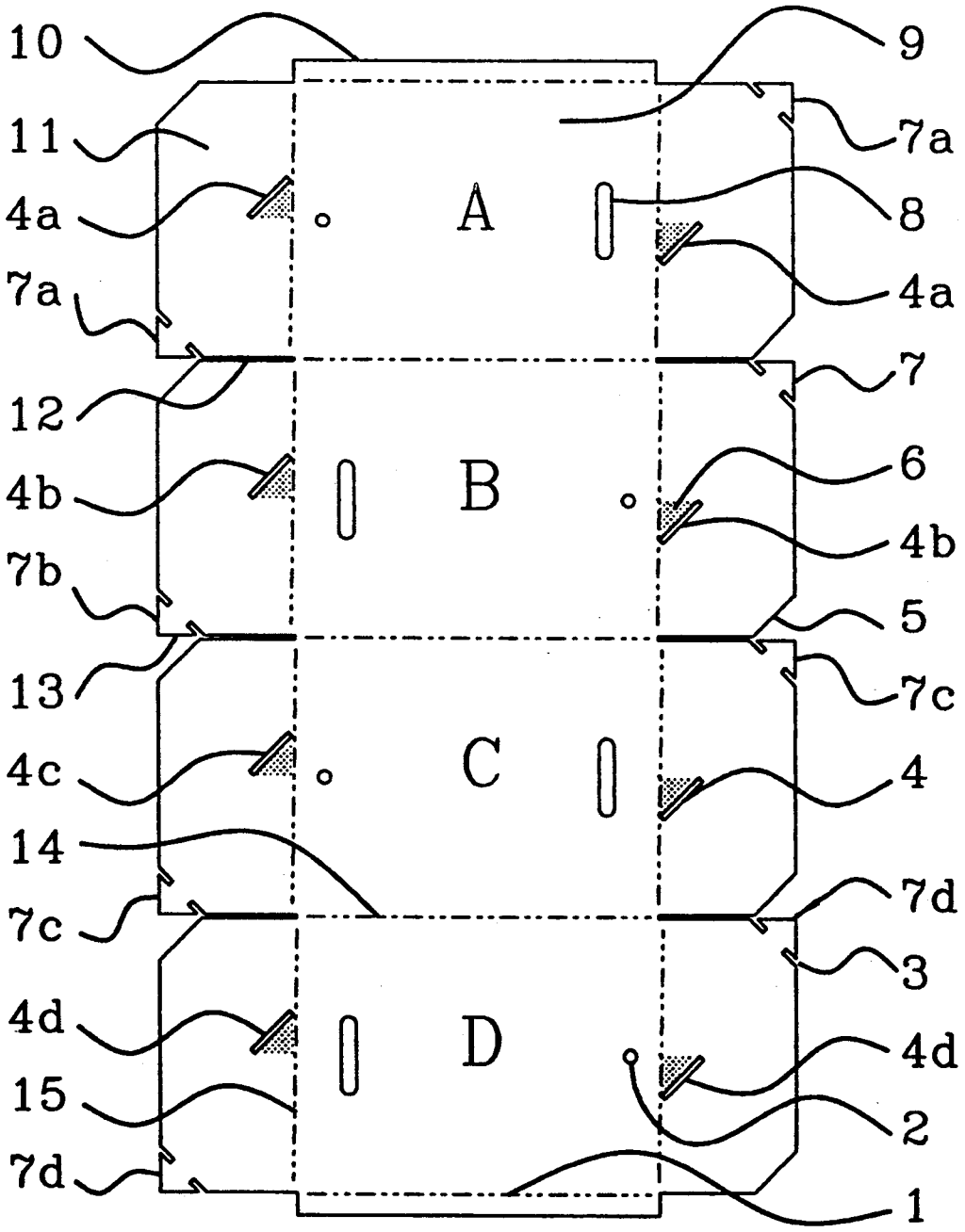
FIG. 1 is a plan view of a blank for assembling the box according to the present invention, seen from the interior surface of the box which is formed.

As shown in FIG. 1, which is an unfolded box blank (interior view), the dotted lines (unnumbered) represent hinges which are folded into a substantially 90° angle when the box is in its erect (closed) form.

The blank according to the present invention can be folded into an erect (closed) box by bending each of the end flaps 11, thus disengaging adjacent end flaps from each other along cut lines 12. Each of the hinged joints 1, 14 and 15 are folded into approximately a 90° angle to allow the corner tabs 7 of an end flap to be inserted into the slot of an adjacent panel end flap, which is spacially oriented to receive the corner tab.

Additionally, each panel has a pair of diagonally disposed cut off corners 5, which facilitate the interlapping of the box end flaps as the box is erected.

Each of the corner tabs 7 may be configured with corner tab-notches 3 which cooperate with the slots 4 when the tabs are inserted therein to hold the box in the assembled configuration.

Adjacent to each slot 4, is a meshed (or textured) area 6 on the interior surface which may be located adjacent to one or more, preferably each slot. The meshed surface 13 is located on the exterior surface of each corner tab 7 to cooperate with the meshed area 6 on the interior surface when the box is in the assembled configuration. In this fashion, some extra resistance may be created, which precludes or inhibits the tabs from disengaging the slots when in use.

Figure 3:
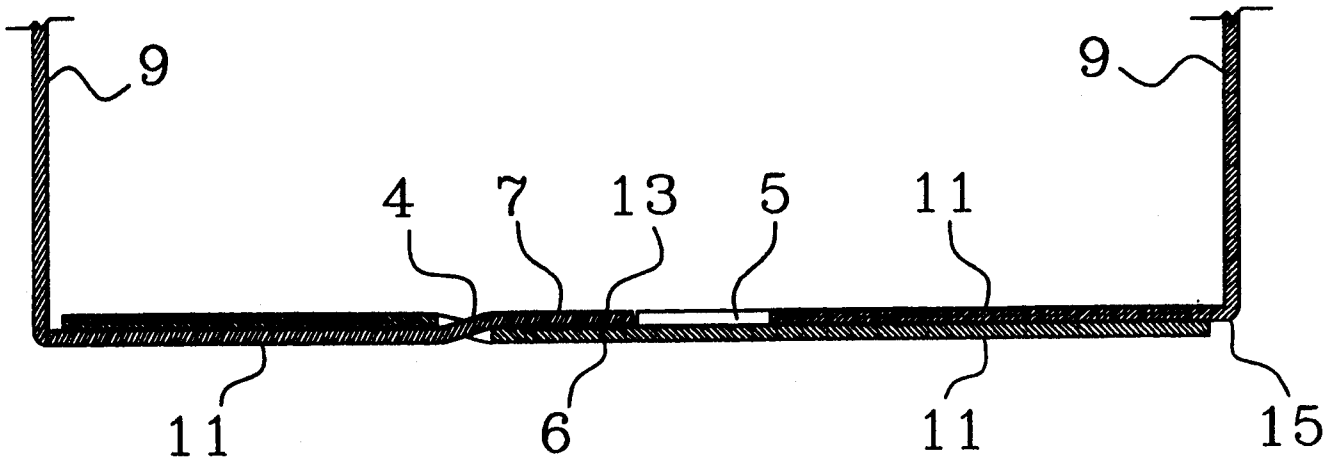
FIG. 3 is a partial cross-sectional view of the interrelationship between the tab and the slot in the folded, erect (or closed) form.

By inserting the tabs into the respective slots with which each tab cooperates from the exterior, the meshed texture area 6 and meshed texture 13 cooperate as shown in detail in FIG. 3.

To assemble the box from the blank described herein, each of the foldable hinges 14 is folded to about a 90° angle as seen from the interior of the box. As each hinge is folded, each end panel is also folded into essentially a 90° angle, perpendicular to the panel to which it is attached, and the tab 7 present on the end panel is inserted into the slot 4 on the end flap of the adjacent panel, such that the meshed areas 6 and 13 engage.

Figure 2:
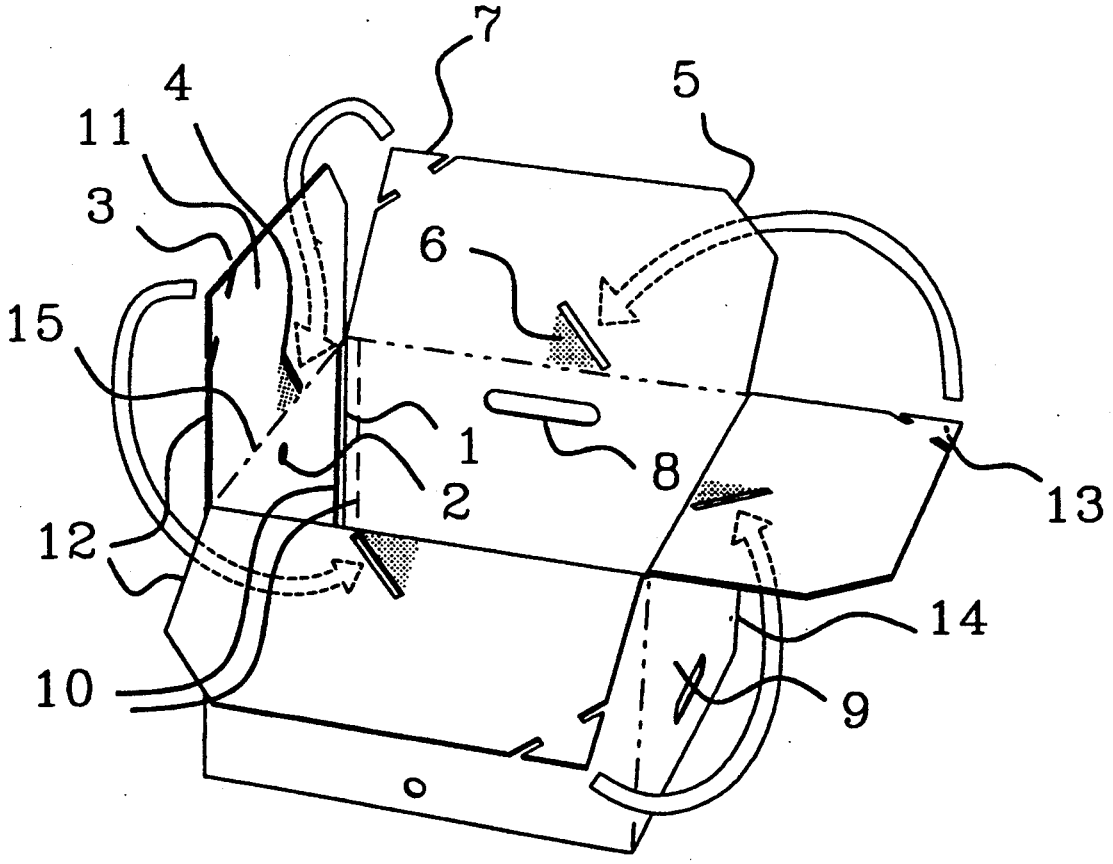
FIG. 2 is a view in perspective of the box partially assembled.

As shown in FIG. 2, the corner tabs cooperate during use with the slots from adjacent panels. As such, tab **7*a* cooperates with slot 4*b*; tab 7*b* cooperates with slot 4*c*** and so forth.

Typically, the hinged panels when in the folded, assembled form, serve as the sides of the box. The interlapping sides are used as the top and bottom of the box. Optional hand holes 8 may be placed in opposing side panels. Typically, such hand holes are placed away from the hinged joints of oppositely disposed panels to utilize the strength of the material from which the box is constructed, thus minimizing any tearing of the box material due to excessive weight when the box is full.

A plurality of optional holes 2 can also be placed in oppositely disposed panels as shown in FIG. 1 as necessary or appropriate for use when the box is in its assembled form, or to hang the blank on a peg during storage, or to insert a pull rope with knotted ends (for tying) or (pulling when in the play mode).

When the overlapping end flaps 1 and 10 are not treated with an adhesive or sealant, the box may be completely unfolded and stored in a completely flat condition. However, by disengaging the meshed areas located on the tabs and adjacent to the slots, the folded joints 1 and 10 need not be disengaged for the box to be collapsible and folded into a bi-layer for storage.

Typically, the blank described above is constructed of material which is of a suitable thickness and sufficient rigidity and quality to be durable and reusable. Corrugated cardboard is one preferred material which is frequently used. Additionally, corrugated cardboard may be impregnated or coated with a sealant to render it substantially moisture resistant, readily markable for labeling or other drawings or writings thereon, etc. The blank may be made of an injection molded plastic material of suitable thickness.

The outer surface may be, for example, coated with colored or decorated paper to provide an ornamental appearance, or color coded such as with a foil, paper or similar material, and may be virtually any color to render the boxes in erect, assembled form color coded or decorative.

The box which is formed using the blank described herein can be generally cubical (all six sides of the same length and width) or rectangular. The size of the box can be varied widely, depending upon the relative strength of the material from which the box is constructed. For example, when the blank is comprised of unreinforced corrugated cardboard, a box about 12 inches wide by about 16 inches long by about 10 inches high is easily formed; however, these dimensions vary widely.

An alternative configuration to the interlocking box described herein (not shown) utilizes a series of four panels as shown generally in FIG. 1, wherein each panel is joined to the adjacent panel by a foldable hinge. However, each panel has an interlapping flap on one end only. Flaps which interlap but do not interlock are on the opposite end. Hence, flaps with tabs 7 and slots 4 could, for example, be used to form the bottom of a box in assembled form, and the non-interlocking flaps on the opposite end create an open box. A separate cover which is removable can be used, or the box can be used in open fashion, such as a bin. Corresponding aligning hand holes (not shown) can be cut in the end flaps to cooperate with the hand holes in the oppositely disposed panels, thereby rendering each hand hole somewhat stronger and easier to use. In this fashion, the flaps without interlocking slots and tabs can be folded into the interior of the box, and serve to strengthen the side panels.

When the outer surface of the box is decorated with fanciful colors or designs, the box can be used by children as a plaything. Such decorative modifications could include handles attached to the outer surface of the box as well as drawings which are entertaining to children.

While the preferred embodiment of the invention is described herein in detail, numerous alternative embodiments are contemplated as falling within the scope of the claims.

I claim:

1. A blank which forms a rectangular box when assembled, comprised of four equally sized and shaped panels integrally hinged to each other in series, each panel having a pair of oppositely disposed end flaps, each such flap being hinged to the panel at the base of the flap and having a pair of corners, one corner being in the form of a pointed tab formed by a pair of notches behind each such tab and the other corner being beveled, such that the tabs on the oppositely disposed flaps on each panel, are diagonally opposed across the said panel, and the beveled corners are diagonally opposed across the said panel.

each flap further having a slot situated adjacent to the hinge at the base of the flap, said slot being located at a point which aligns and cooperates with the tab from a flap on an adjacent panel when the box is assembled, said box being comprised of four sides and having closed top and bottom surfaces comprised of interlapping and interlocking flaps in the assembled configuration.

2. A blank in accordance with claim 1 further comprised of a meshed surface adjacent to said slot on each flap.

3. A blank in accordance with claim 2 wherein at least one tab has a meshed area which cooperates with the meshed area adjacent to the slot when the box is in the assembled configuration.

* * * * *